US007914723B2

(12) United States Patent
Kim et al.

(10) Patent No.: US 7,914,723 B2
(45) Date of Patent: Mar. 29, 2011

(54) NONWOVEN BONDING PATTERNS PRODUCING FABRICS WITH IMPROVED ABRASION RESISTANCE AND SOFTNESS

(75) Inventors: Kyuk Hyun Kim, Weatogue, CT (US); Valeria G. Erdos, Avon, CT (US); Smita Bais-Singh, Farmington, CT (US)

(73) Assignee: Ahlstrom Corporation, Helsinki (FI)

( * ) Notice: Subject to any disclaimer, the term of this patent is extended or adjusted under 35 U.S.C. 154(b) by 804 days.

(21) Appl. No.: 11/739,348

(22) Filed: Apr. 24, 2007

(65) Prior Publication Data

US 2008/0268194 A1 Oct. 30, 2008

(51) Int. Cl.
*D01D 10/00* (2006.01)
*B29C 59/02* (2006.01)
*B32B 27/14* (2006.01)

(52) U.S. Cl. ..... 264/173.1; 264/172.17; 264/172.19; 264/175; 264/210.2; 264/210.8; 264/284; 264/293; 264/310; 264/320; 264/324; 428/175; 428/196; 428/198

(58) Field of Classification Search ..... None
See application file for complete search history.

(56) References Cited

U.S. PATENT DOCUMENTS

| | | | | |
|---|---|---|---|---|
| 3,855,046 | A | 12/1974 | Hansen | |
| 4,035,219 | A * | 7/1977 | Cumbers | 156/290 |
| 4,154,885 | A * | 5/1979 | Tecl et al. | 428/198 |
| 4,234,655 | A | 11/1980 | Kunimune et al. | |
| 4,315,965 | A * | 2/1982 | Mason et al. | 428/198 |
| 5,277,974 | A | 1/1994 | Kubo et al. | |
| 5,372,885 | A | 12/1994 | Tabor et al. | |
| 5,587,225 | A * | 12/1996 | Griesbach et al. | 428/198 |
| 5,964,742 | A | 10/1999 | McCormack et al. | |
| 6,200,669 | B1 * | 3/2001 | Marmon et al. | 428/198 |
| 6,607,810 | B1 * | 8/2003 | Boich | 428/172 |
| 6,623,837 | B2 * | 9/2003 | Morman et al. | 428/152 |
| 2002/0144384 | A1 | 10/2002 | Maugans | |
| 2004/0005457 | A1 * | 1/2004 | DeLucia et al. | 428/364 |
| 2005/0093197 | A1 * | 5/2005 | Dahringer et al. | 264/172.15 |
| 2007/0117481 | A1 * | 5/2007 | Day et al. | 442/50 |
| 2007/0173162 | A1 * | 7/2007 | Ethiopia et al. | 442/327 |
| 2009/0123707 | A1 * | 5/2009 | Skoog et al. | 428/172 |

FOREIGN PATENT DOCUMENTS

| | | | |
|---|---|---|---|
| DE | 19851667 | A1 | 5/2000 |
| WO | 9914415 | A1 | 3/1999 |
| WO | 2004003278 | A1 | 1/2004 |

OTHER PUBLICATIONS

International Preliminary Report on Patentability in related PCT Application No. PCT/FI2008/050220, mailed May 5, 2009.

Communication pursuant to Article 94(3) EPC, European Patent Office examination report in corresponding European Application No. 08 761 623.1-2124, dated May 6, 2010.

* cited by examiner

*Primary Examiner* — Jeffrey Wollschlager

(74) *Attorney, Agent, or Firm* — Ostrager Chong Flaherty & Broitman P.C.

(57) ABSTRACT

A thermal bonding pattern for nonwoven fabric possessing improved abrasion resistance while retaining softness, comprising a basket-weave pattern or other pattern having a transition area (2) equal to at least 10% of bonding spot area (1) in FIG. 3, more preferably a transition area (2) equal to at least 50% of bonding spot area (1), and most preferably a transition area (2) equal to at least 100% of bonding spot area.

11 Claims, 4 Drawing Sheets

PRIOR ART

NONWOVEN BONDING PATTERNS PRODUCING FABRICS WITH IMPROVED ABRASION RESISTANCE AND SOFTNESS

FIELD OF THE INVENTION

The present invention relates to the field of nonwoven fabrics such as those produced by the meltblown and spunbonding processes. Such fabrics are used in a myriad of different products, e.g., garments, personal care products, infection control products, outdoor fabrics, and protective covers.

BACKGROUND OF THE INVENTION

Bicomponent fibers are fibers produced by extruding two polymers from the same spinneret with both polymers contained within the same filament. The advantage of the bicomponent fibers is that it possesses capabilities that can not be found in either of the polymers alone. Depending on the arrangement and relative quantities of the two polymers, the structure of bicomponent fibers can be classified as core and sheath, side by side, tipped, microdenier, mixed fibers, etc.

Sheath-core bicomponent fibers are those fibers where one of the components (core) is fully surrounded by the second component (sheath). The core can be concentric or eccentric relative to the sheath and possessing the same or different shape compared to the sheath. Adhesion between the core and sheath is not always essential for fiber integrity. The sheath-core structure is employed when it is desirable for the surface of the fiber to have the property of the sheath such as luster, dyeability or stability, while the core may contribute to strength, reduced cost and the like. A highly contoured interface between sheath and core can lead to mechanical interlocking that may be desirable in the absence of good adhesion.

Generally, composite bicomponent sheath-core fibers have been used in the manufacture of non-woven webs, wherein a subsequent heat and pressure treatment to the non-woven web causes point-to-point bonding of the sheath components, which is of a lower melting point than the core, within the web matrix to enhance strength or other such desirable properties in the finished web or fabric product.

Poor abrasion resistance of Polyethylene/Polyethylene Terephthalate (PE/PET) sheath/core bicomponent spunbond has been an industry recognized problem since the last 10-15 years. Various approaches have been devised attempting to solve this problem. Similar problems also affect many other frequently used sheath/core structures such as PE/Polyesters (for example, Polybutylene Terephthalate (PBT), Polytrimethylene Terephthalate (PTT), Polylactide (PLA)), PE/Polyolefins, PE/Polyamide, PE/Polyurethanes.

A first method is directed to the modification of fiber structure to improve adhesion between the sheath and core component. For example, a mixture of EVA (ethyl vinyl acetate) and PE was suggested for a sheath component in U.S. Pat. Nos. 4,234,655, 5,372,885 teaches the use of a blend of maleic anhydride grafted HDPE and un-grafted LLDPE (linear low density polyethylene). A mixture of PE and acrylic acid copolymer was suggested in U.S. Pat. No. 5,277,974 and a blend of HDPE (high density polyethylene) with LLDPE was claimed in WO 2004/003278A1 as a sheath component.

An approach for improving abrasion resistance proposed is by increasing the bond area of the spunbond, for example, U.S. Pat. Appl. Publ. No. 20020144384 teaches a non-woven fabric with a bond area of at least about 16%, 20% or 24%. However, higher bond area samples results in loss of softness and drapeability of bicomponent spunbond, which is not desirable for many applications especially for medical apparel such as surgical gowns. At the other extreme, nonwovens with small bond areas tend to make soft feeling but very weak fabric.

Another approach involves the use of a number of treatments, such as multiple washings and chemical treatments.

Yet another approach, which is of particular relevance to the subject matter of this application, is directed to adopting a specific thermal bonding pattern for nonwoven fabric comprising a pattern having an element aspect ratio between about 2 and about 20 and unbonded fiber aspect ratio of between about 3 and about 10, as disclosed in U.S. Pat. No. 5,964,742. Such a pattern has been found to possess a higher abrasion resistance and strength than a similar fabric bonded with different bond patterns of similar bond area.

There remains a need for a nonwoven fabric without resort to chemical treatments having good bonding strength (i.e. tensile strength and abrasion resistance) yet also having good fabric softness, particularly at relatively high bonding area.

Accordingly, it is an object of this invention to provide a nonwoven fabric with a high bonding area while retaining softness and comparable or better tensile strength and abrasion resistance compared to fabrics bonded with other known patterns.

It is another object of this invention to provide a method of preparing a nonwoven fabric with a high bonding area while retaining softness and comparable or better tensile strength and abrasion resistance.

SUMMARY OF THE INVENTION

The objects of the present invention are met by a thermal bonding pattern for nonwoven fabric comprising a basket-weave pattern having a transition area (2) equal to at least 10% of bond spot area (1), more preferably a transition area (2) equal to at least 50% of bond spot area (1), and most preferably a transition area (2) equal to at least 100% of bond spot area (1). It has been unexpectedly found that such a fabric has a higher abrasion resistance and strength than a similar fabric bonded with different bond patterns without the attendant loss of softness.

The objects are also met by a method of manufacturing a pattern bonded nonwoven fabric comprising the steps of spinning and stretching thermoplastic fibers in a spunbonded process, laying the spunbonded thermoplastic fibers down to form a web, and passing the web between an embossed roll having a basket-weave pattern engraved therein and a flat roll to create a basket-weave bond pattern in the web having bonded regions and non-bonded regions connected by transition regions of partially bonded fibers, the transition regions surrounding each of the bonded regions and having bonding that changes gradually from a fully bonded state near the bonded regions to a fully non-bonded state near the non-bonded regions, the transition regions having an area equal to at least 10% of an area of the bonded regions The nonwoven fabric of this invention can be prepared using calendering and embossing processes. Although single pass, double pass, s wrap and 3 stack with idler can all be used, double pass is most preferred.

BRIEF DESCRIPTION OF THE DRAWINGS

FIG. 8 is an SEM cross-sectional image of a nonwoven web made by using a cross-hatch pattern of prior art drawing of the dimension of cross-hatch pattern.

DEFINITIONS

Figure 1:
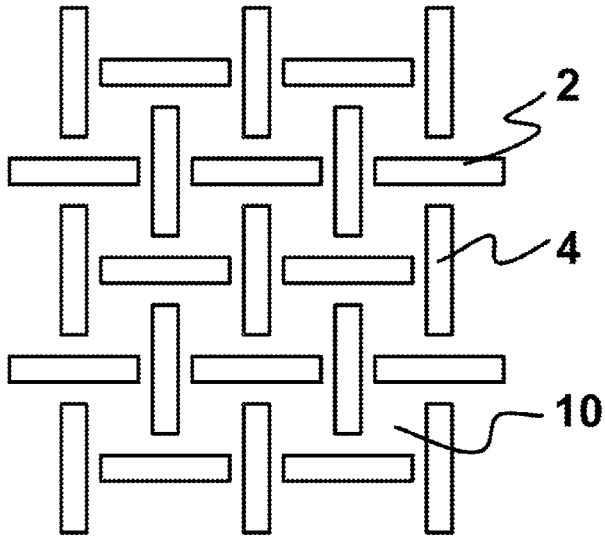
Fig. 1 PRIOR ART
FIG. 1 is a schematic drawing of a prior art cross-hatch bonding pattern.

The term "spunbond" filaments as used herein means filaments which are formed by extruding molten thermoplastic polymer material as filaments from a plurality of fine capillaries of a spinneret with the diameter of the extruded filaments then being rapidly reduced by drawing. Spunbond filaments are generally continuous and usually have an average diameter of greater than about 5 microns. The spunbond filaments of the current invention preferably have an average diameter between about 5 to 60 microns, more preferably between about 10 to 20 microns. Spunbond nonwoven fabrics or webs are formed by laying spunbond filaments randomly on a collecting surface such as a foraminous screen or belt. Spunbond webs can be bonded by methods known in the art such as hot-roll calendering, through air bonding (generally applicable to multiple component spunbond webs), or by passing the web through a saturated-steam chamber at an elevated pressure. For example, the web can be thermally point bonded at a plurality of thermal bond points located across the spunbond fabric.

The term "nonwoven fabric, sheet or web" as used herein means a structure of individual fibers, filaments, or threads that are positioned in a random manner to form a planar material without an identifiable pattern, as opposed to a knitted or woven fabric.

The term "filament" is used herein to refer to continuous filaments whereas the term "fiber" is used herein to refer to either continuous or discontinuous fibers.

The term "multiple component filament" and "multiple component fiber" as used herein refer to any filament or fiber that is composed of at least two distinct polymers which have been spun together to form a single filament or fiber. Preferably the multiple component fibers or filaments of this invention are bicomponent fibers or filaments which are made from two distinct polymers arranged in distinct substantially constantly positioned zones across the cross-section of the multiple component fibers and extending substantially continuously along the length of the fibers. Multiple component fibers and filaments useful in this invention include sheath-core and island-in-the-sea fibers.

As used herein "thermal point bonding" involves passing a fabric or web of fibers to be bonded between a heated calender roll and an anvil roll. The calender roll is usually, though not always, patterned in some way so that the entire fabric is not bonded across its entire surface, and the anvil roll is usually flat. As a result, various patterns for calender rolls have been developed for functional as well as aesthetic reasons. One example of a pattern has points and is the Hansen-Pennings or "H&P" pattern with about a 30% bond area with about 200 pins/square inch as taught in U.S. Pat. No. 3,855,046 to Hansen and Pennings. The H&P pattern has square point or pin bonding areas. Another typical point bonding pattern is the expanded Hansen-Pennings or "EHP" bond pattern which produces a 15% bond area. Another typical point bonding pattern designated "714" has square pin bonding areas where in the resulting pattern has a bonded area of about 15%. Other common patterns include a diamond pattern with repeating and slightly offset diamonds with about a 16% bond area and wire weave pattern looking as the name suggests, e.g. like a window screen, with about an 18% bond area. Typically, the percent bonding area varies from around 10% to 30% of the area of the fabric laminate web. As is well known in the art, the spot bonding holds the laminate layers together as well as imparts integrity to each individual layer by bonding filaments and/or fibers within each layer.

As used herein, the term "garment" means any type of non-medically oriented apparel which may be worn. This includes industrial work wear and coveralls, undergarments, pants, shirts, jackets, gloves, socks, and the like.

As used herein, the term "infection control product" means medically oriented items such as surgical gowns and drapes, face masks, head coverings like bouffant caps, surgical caps and hoods, footwear like shoe coverings, boot covers and slippers, wound dressings, bandages, sterilization wraps, wipers, garments like lab coats, coveralls, aprons and jackets, patient bedding, stretcher and bassinet sheets, and the like.

As used herein, the term "personal care product" means diapers, training pants, absorbent underpants, adult incontinence products, and feminine hygiene products.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn furniture, as well as floor coverings, table cloths and picnic area covers.

As used herein, the term "outdoor fabric" means a fabric which is primarily, though not exclusively, used outdoors. Outdoor fabric includes fabric used in protective covers, camper/trailer fabric, tarpaulins, awnings, canopies, tents, agricultural fabrics, and outdoor apparel such as head coverings, industrial work wear and coveralls, pants, shirts, jackets, gloves, socks, shoe coverings, and the like.

As used herein, the term "transition area" refers to an area in substrate surrounding the bond point area, where the fibers are sufficiently heated and compressed to exhibit some amount of bonding.

Test Methods

Stoll Abrasion Test was used for measuring the relative resistance to abrasion of a fabric in the examples presented hereinafter. The test results are reported on a scale of 0 to 5 with 5 being the most wear and 0 the least, after 100 cycles with a weight of 2.5 lbs. The test is carried out with a Stoll Quatermaster Abrasion tester such as model no. CS-22C-576 available from SDL Inc. or Testing Fabrics Inc. The abradant cloth used is a 3 inch by 24 inch with the longer dimension in the wrap direction. The test specimen size is a 4 inch by 4 inch.

The softness of a nonwoven fabric was measured according to the "Handle-O-Meter" test. The test used here is:1) the specimen size was 4 inches by 4 inches and 2) five specimens were tested. The test was carried out on Handle-O-Meter model number 211-5 from Thwing Albert Instrument Co., 10960 Dutton Road, Philadelphia, Pa. 19154.

DETAILED DESCRIPTION OF THE INVENTION

In order to avoid the trade-off between the abrasion resistance and softness seen in most conventional patterns, the inventors have discovered a pattern termed basket-weave pattern which comprises a large transition area interconnecting bonded and non-bonded area. Such a pattern results in a soft nonwoven web with high abrasion resistance with a bond area as high as 50%, typically in the range of 5 to 50%.

FIGS. 4-7 show a basket-weave pattern. The roundness of the basket-weave pattern contributes to the existence of noticeable transition areas.

The transition area works as a connection for both bonded and non-bonded area, and contributes to building-up the network structure, which strengthens the resistance of the fibers against the applied shear or normal stress during the abrasion process, without compromising softness and drapeability. It is also found that the integrity and amount of the transition area is critical for both abrasion resistance and softness, as basket weave with relatively large transition area gives this effect but other patterns with negligible transition area compromise softness greatly for similar improvement in abrasion resistance.

While not to be bound by theory, it is hypothesized that abrasion resistance is improved by the basket-weave pattern because more fibers are tied down by the existence of the transition area. However, since in the transition area, fibers are not fully melted and fixed, they have enough freedom to move, and because of the flexibility of the fibers softness does not deteriorate.

FIG. 1 illustrates, as an example of various bonding patterns known from prior art, a cross-hatch bonding pattern. In the cross-hatch pattern the bond spots 2 and 4 are very sharply limited and are not surrounded by any substantial presence of transition regions, which results in an abrupt transition from a fully bonded state to a fully non-bonded state (regions 10 between the bond spots 2 and 4).

Figure 2:
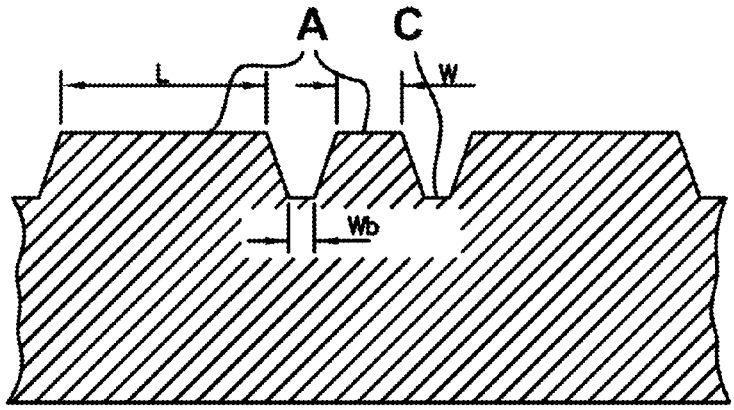
FIG. 2 is a partial radial cross-sectional drawing of an embossing roll designed to create the cross-hatch pattern of FIG. 1.

FIG. 2 shows a partial radial cross-section along the axis of an embossing roll having a typical cross-hatch bonding pattern on its surface used for producing the bonding pattern of FIG. 1. The cross-section shows such a part of a roll surface that forms two horizontally extending bond spots 2 (see FIG. 1) and one vertically extending bond spot 4 (see FIG. 1) therebetween. The embossing pins or protrusions are truncated pyramids having a rectangular bottom in shape. The highest surface protrusion A having a length L and a width W creates the bond spots 2 and 4 of FIG. 1. Since the side surfaces of the truncated pyramid slope steeply, no additional compression, in practice, takes place outside of region A, resulting in no transition region between the bonded and non-bonded regions. The width of the depressed region C (seen as the non-bonded region 10 in FIG. 1) between two bond spots is Wb. In a practical example, L is 2.36 mm, W is 0.48 mm and Wb is 0.2 mm.

Figure 3:
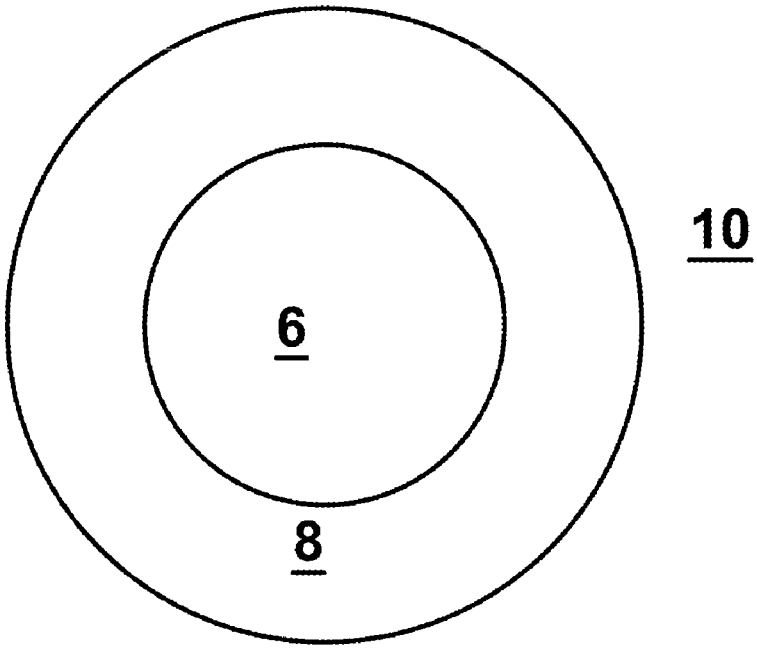
FIG. 3 is a schematic drawing of an exemplary single bond spot surrounded by a transition region in accordance with a preferred embodiment of the present invention.

FIG. 3 illustrates schematically in connection with a single round bond spot or bond region 6, a transition region 8, which surrounds the bond region. The transition region 8 connects the fully bonded region 6 and the non-bonded region 10. As a result, in the transition region 8, the fully bonded state of the nonwoven web at bond region 6 is transformed gradually to fully non-bonded state of the nonwoven web at non-bonded region 10. Thus, the transition region 8 increases the effective bond area, but in such a manner that the drapeability and softness of the nonwoven web are not sacrificed.

Figure 4:
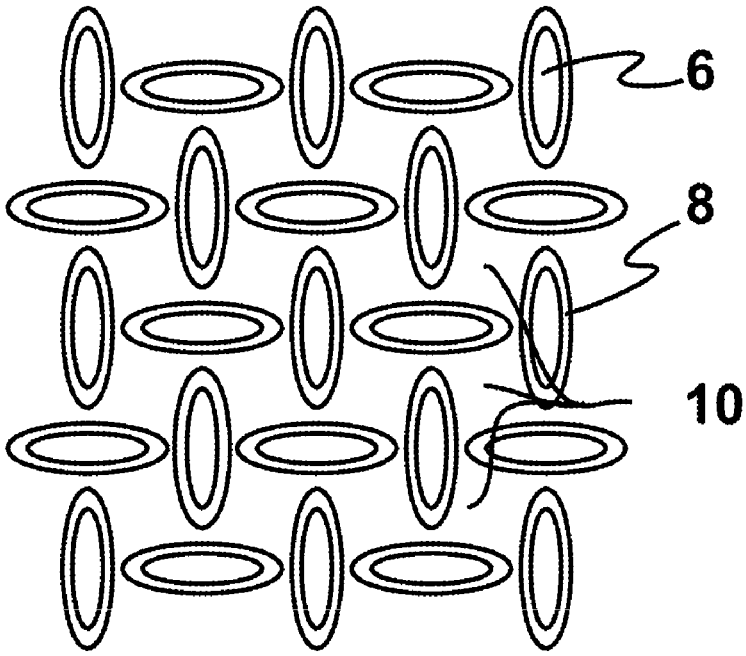
FIG. 4 is a schematic drawing of a basket-weave bonding pattern showing a transition region.

FIG. 4 illustrates schematically a practical application of the bond spot or region 6 together with a transition region 8 arranged in a basket weave pattern, where the bond spots 6 are oval and are surrounded by transition regions 8.

Figure 5:
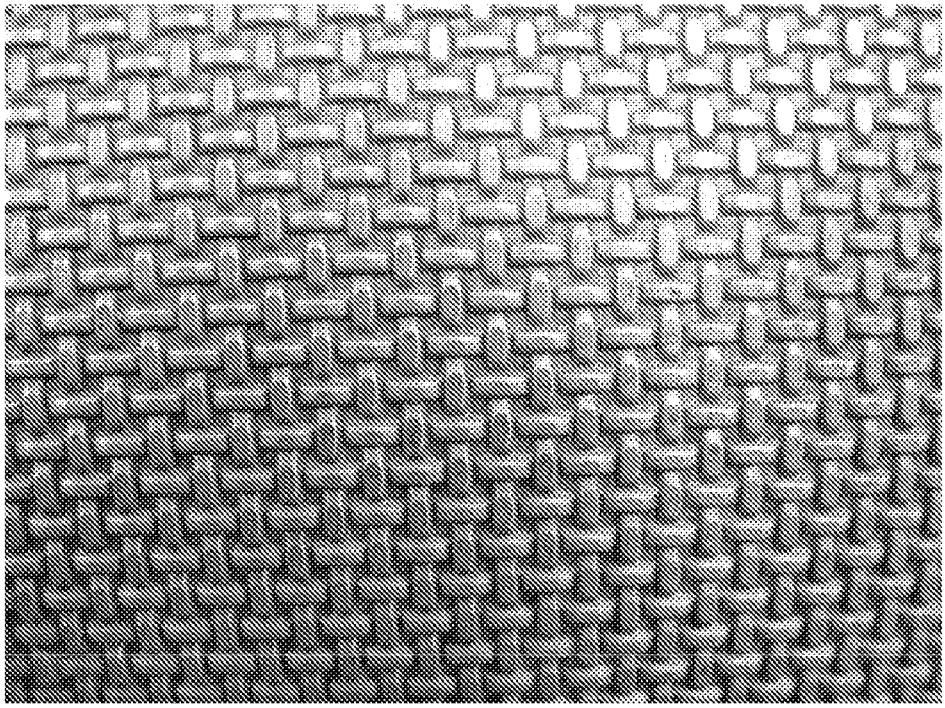
FIG. 5 is a top view of an embossing roll with a basket-weave pattern including a transition region.

FIG. 5 shows a photo taken as a top view of an embossing roll with a basket-weave pattern including transition regions.

Figure 6:
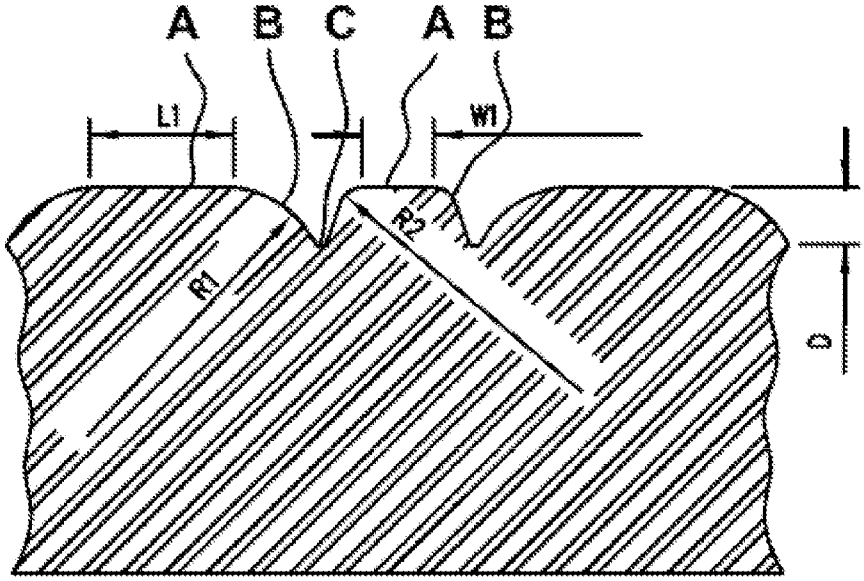
FIG. 6 is a partial radial cross-sectional drawing of an embossing roll designed to create a basket-weave pattern with a transition region.

FIG. 6 is a partial cross-sectional radial view along the axis of the embossing roll of FIG. 5. The roll surface is specifically designed to create a basket-weave pattern with bond spots 6 and transition regions 8 basically as shown in FIG. 4. The upper, i.e., the working surface of the roll in FIG. 6, forms, when compared with FIGS. 4 and 5, two horizontally extending bond regions and one vertically extending bond region or spot therebetween. The protruded surface portion A of this bond geometry creates the bond spot 6 (see FIG. 4) having a length L1 and width W1 with highest or full bonding, while the convex shaped portion B between the protruded region A and the depressed region C creates the transition region 8 (see FIG. 4) where the bonding between the fibers gets weaker towards the depressed region C. In a practical example, the length L1 of the bond spot or region 6 is 1.4-2.1 mm, and the width W1 is 0.8 to 1.1 mm. The depth D of the depressed regions is 1 mm. The radius R1 in the convex shaped portion B at the longer side of the protrusion is 0.5 mm, and the radius at the ends of the protrusion is 1.8 mm.

For the basket-weave geometry shown in FIGS. 4 and 6, the transition region 8 surrounding the bond spot 6 is created by means of the convex portion B in the embossing roll geometry, which connects the region A with highest surface protrusion and the depressed region C. A spot bond 6 is created between the parallel roll surfaces (in practice, another roll having normally a smooth surface is positioned against the highest surface protrusions when performing the bonding), in presence of heat, where the highest amount of pressure is created between the two opposite roll surfaces. The convex geometry of the region B in basket-weave pattern, allows compression nonwoven produce in this zone as well, although not with the same amount of pressure as in region A. The protrusions illustrated in FIG. 6 show two types of convex portions. While the convex portion at the longer sides of the protrusion has a substantially long radius, the corresponding radius at the ends of the protrusion is so small that only a short transition region is formed to the ends of the bond spots or regions.

Figure 7:
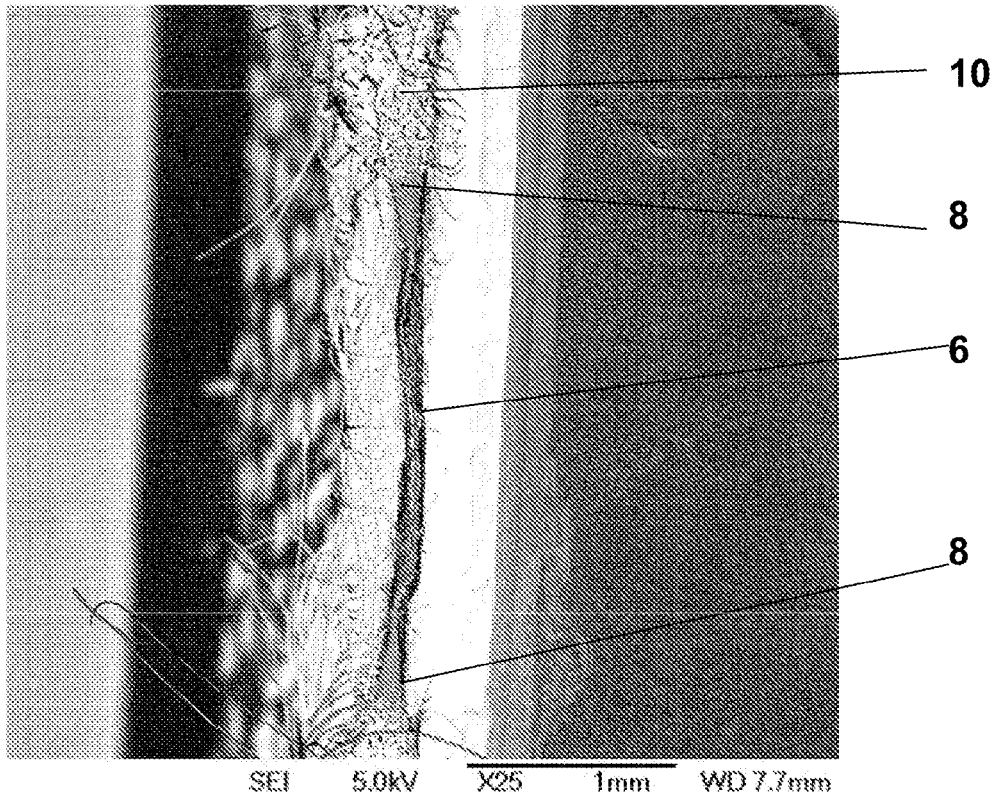
FIG. 7. is an SEM (Scanning Electron Microscope) cross-sectional image of a nonwoven web with a basket weave pattern showing the transition region and the bond spot.
Figure 8:
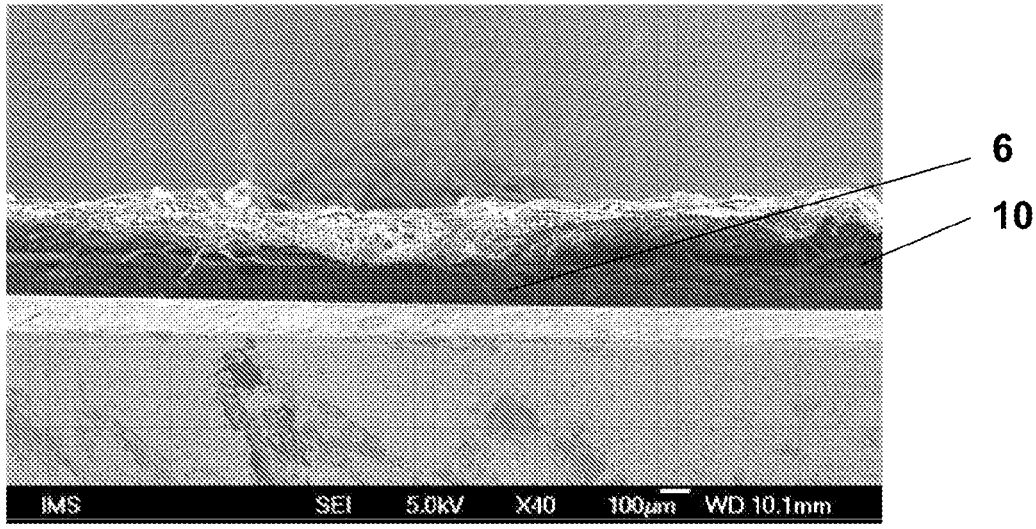
FIG. 8 is an SEM cross-sectional image of a nonwoven web made by using a cross-hatch pattern of prior art.

The nature of the transition region 8 in a basket weave non-woven product may be seen from FIG. 7 while its absence may be seen from the cross-hatch product of FIG. 8. FIGS. 7 and 8 are SEM cross-sectional images of the two mentioned nonwoven products. In FIG. 7, both the bond region 6 and the transition region 8 on both sides of the bond region can be clearly seen before the non-bonded region 10 begins. FIG. 8 shows the bond spot 6, and at the right side of the photo an abrupt change from the fully bonded state 6 to the non-bonded state 10.

The method of conducting the thermal point bonding is also shown to affect the properties of the products. Examples of suitable calendering methods include single pass, double pass, S wrap etc. In most occasions, it was found that double pass calendering is preferred and especially suited for generating desirable combination of properties.

Tests of fabrics bonded with an example of the inventive pattern (basket weave pattern) and with representative conventional patterns are presented herewith showing the advantageous properties of the inventive pattern.

EXAMPLE 1

A nonwoven base material was produced using 40/60 PE/PET sheath/core bicomponent spunbond fibers through pressure bonding with cold calender rolls at room temperature at a nip pressure of 400 pli. The base material has a basis weight of 40 gsm.

For the test samples, the base material was thermally point bonded using basket-weave pattern with 30% bond area or using a diamond pattern with 40% bond area. Both bonding experiments were conducted at various calender temperatures (239-266° F. of both top and bottom rolls), and speeds (10-200 ft/min), and range of nip pressures (75-1500 pli).

The thermal point bonding was performed using an embossed roll and a smooth roll in a single pass. Both the test samples and control samples have a basis weight of 40 gsm.

The test data are summarized in Table 1.

TABLE 1

| Additional Treatment Step | | | Bond | Temp. | Pressure | Result Abrasion | |
|---|---|---|---|---|---|---|---|
| Material | Top Roll | Bottom Roll | Area (%) | (° F.) | (pli) | Resistance | Softness |
| Test BW1 | Smooth | B-W | 30 | 252 | 350 | 0.8 | 39.3 |
| Test Dia1 | Smooth | Diamond | 40 | 266 | 75 | 1.3 | 23.9 |
| Control 1 | NA | NA | 18 | 265 | 600 | 2.5 | 43.3 |

In Table 1, results are presented for two test samples against a control sample, i.e., a first test sample BW1 processed through a top roll of steel with smooth surface and a bottom roll of steel with basket-weave patterns and a second test sample Dial processed through a top roll of steel with smooth surface and a bottom roll of steel with diamond pattern.

It can be concluded that when the samples are bonded at single bonding step, basket-weave pattern at 30% bonding area not only showed better abrasion resistance than standard bonding pattern (oval, 18%), but also better than a diamond bonding pattern with 40% bonding area. As a surprising side effect, samples acquired a texture and bulkiness when embossed with basket-weave pattern with single pass (29% increase of thickness from 245 to 316 μm).

EXAMPLE 2

A nonwoven base material was produced using 40/60 PE/PET sheath/core bicomponent spunbond fibers through thermal bonding on a calender roll with an oval pattern with 18% bonding area at 265° F. and at a nip pressure of 600 pli. The base material has a basis weight of 40 gsm.

For the test samples, the base material was thermally point bonded using basket-weave pattern with 30% bond area. The bonding was conducted at various calender temperatures (239-266° F. of both top and bottom rolls), and a fixed speed of 10 ft/min and a nip pressure of 750 pli.

The thermal point bonding was performed using an embossed roll and a smooth roll in a double pass for the test sample.

The control sample was prepared in a single pass under the conditions specified in Example 1. Both the test and the control samples have a basis weight of 35 gsm.

The test data are summarized in Table 2.

TABLE 2

| Additional Treatment Step | | | Bond | Temp. | Pressure | Result Abrasion | |
|---|---|---|---|---|---|---|---|
| Material | Top Roll | Bottom Roll | Area (%) | (° F.) | (pli) | Resistance | Softness |
| Test BW2 | Smooth | B-W | 30 | 250 | 750 | 0.0 | 28.6 |
| Control 2 | NA | NA | 18 | 265 | 600 | 2.3 | 30.6 |

In Table 2, results are presented for the test sample BW2 processed through a top roll of steel with smooth surface and a bottom roll of steel with basket-weave patterns and a control sample.

It can be concluded that when the basket weave pattern was used in the second bonding step, in conjunction with standard bonding pattern (oval, 18%) as the first step, the improvement in abrasion resistance was even greater compared to the basket-weave sample bonded in a single step (Example 1). As a surprising side effect, samples acquired a texture and bulkiness when embossed with basket-weave pattern with double pass (36% increase of thickness from 250 to 340 μm).

EXAMPLE 3

A nonwoven base material was produced using 40/60 PE/PET sheath/core bicomponent spunbond fibers through thermal bonding on a calender roll with an oval pattern with 18% bonding area at 265° F. and at a nip pressure of 600 pli. The base material has a basis weight of 40 gsm.

For the test samples, the base material was thermally point bonded using basket-weave pattern with 30% bond area. The bonding was conducted at a fixed temperature 276° F., at a fixed speed of 200 ft/min and at a nip pressure of 750 pli.

The thermal point bonding was performed using an embossed roll and a smooth roll in a double pass for the test sample.

The control sample was prepared in a single pass under the same conditions as the test material except that a single pass is used. Both the test samples and control samples have a basis weight of 40 gsm.

The test data are summarized in Table 3.

TABLE 3

| Additional Treatment Step | | | Bond | Temp. | Pressure | Result | |
|---|---|---|---|---|---|---|---|
| | | | | | | Abrasion | |
| Material | Top Roll | Bottom Roll | Area (%) | (° F.) | (pli) | Resistance | Softness |
| Test BW3 | Smooth | B-W | 30 | 235 | 400 | 0.5 | 29.1 |
| Control 3 | NA | NA | 18 | 265 | 600 | 2.5 | 43.3 |

In Table 3, results are presented for the test sample BW3 processed through a top roll of steel with smooth surface and a bottom roll of steel with basket-weave patterns and a control sample.

It can be concluded that the basket weave pattern contributed to improving the abrasion resistance at the speed of 200 ft/min in a double pass setup while retaining softness.

EXAMPLE 4

A nonwoven base material was produced using 40/60 PE/PET sheath/core bicomponent spunbond fibers through thermal bonding on a calender roll with an oval pattern with 18% bonding area at 265° F. and at a nip pressure of 600 pli. The base material has a basis weight of 30 gsm.

For the test samples, the base material was thermally point bonded using a cross-hatch pattern with 22.7% bond area, using a diamond pattern with 17.1% bond area, and using a square pattern with 19% bond area at various speeds (98-656 ft/min), at a fixed temperature 257° F. for both top and bottom rolls and at a fixed nip pressure of 286 pli.

The thermal point bonding was performed using single pass, double pass or S wrap as shown in Table 4. The bottom roll is either absent or a Cold Steel Smooth Roll. The top roll, when present, is a steel roll bearing the respective patterns. All the samples have a basis weight of 40 gsm.

The test data are summarized in Table 4.

TABLE 4

| Additional Treatment Step | | | | Bond | | | | Result | |
|---|---|---|---|---|---|---|---|---|---|
| Material | Top Roll | Middle Roll | Bottom Roll | Area (%) | Process Setup | T. (° F.) | P. (pli) | Abrasion Resistance | Softness |
| Control 4 | NA | Smooth | NA | 18 | Single pass | 265 | 600 | 2.0 | 13.3 |
| Test CH1 | Cross Hatch | Smooth | Cold Smooth | 23 | S wrap | 257 | 286 | 1.8 | 21.4 |
| Test CH2 | Cross Hatch | Smooth | NA | 23 | Double Pass | 257 | 286 | 1.0 | 25.1 |
| Test Dia4.1 | Diamond | Smooth | Cold Smooth | 17 | S Wrap | 257 | 286 | 1.3 | 32.8 |
| Test Dia4.2 | Diamond | Smooth | NA | 17 | Double Pass | 252 | 286 | 2.3 | 22.3 |
| Test S4.1 | Square | Smooth | Cold Smooth | 19 | S Wrap | 266 | 286 | 2.0 | 31.2 |
| Test S4.2 | Square | Smooth | NA | 19 | Double Pass | 257 | 286 | 0.5 | 49.1 |

In Table 4, results are presented for the test samples processed using cross-hatch, diamond, or square patterns on a double pass or S wrap setup, compared to a control sample prepared using single pass setup.

It can be concluded that the cross-hatch pattern, despite its similarity in shape to basket-weave pattern, did not contribute to a noticeable improvement in the abrasion resistance with S Wrap configuration, but gave an improvement using double pass. Improvement in the abrasion resistance did not take place in diamond pattern for the cases of double pass configuration. Some improvement was noticed in abrasion resistance with S Wrap, but softness deteriorated. Improvement in an abrasion resistance took place in square pattern in case of double pass at the expense of softness.

EXAMPLE 5

Three nonwoven base materials, classified as "DG", "LG" and "White", were produced using 40/60 PE/PET sheath/core bicomponent spunbond fibers and posses a density of 30 gsm. "DG" and "LG" are fully bonded samples, which are thermally bonded on a calender roll (oval pattern, 18% bond area) at 275° F., at a nip pressure of 600 pli and at a speed of 550 ft/min. "White" is a lightly bonded sample, which is thermally bonded on calender roll (oval pattern, 18% bond area) at 215° F., at a nip pressure of 400 pli and at a speed of 550 ft/min.

For the test samples with basket-weave patterns, the base material was thermally bonded using basket-weave pattern with 30% bond area at various configurations (double pass, s wrap, and 3 stack with idler), at a temperature range of 230-275° F., at a nip pressure of 400-629 pli and at a fixed speed of 656 ft/min.

For the test samples with patterns other than basket-weave, the base material was thermally bonded using square-patterned sleeves with 33% bond area, square-patterned sleeves with 13% bond area, or square-patterned sleeves with 27% bond area, at a double pass, at a temperature range of 257-266° F., at a nip pressure of 343-514 pli and at a fixed speed of 98 ft/min.

All the samples have a basis weight of 30 gsm.

The test data are summarized in Table 5.

TABLE 5

| Additional Treatment Step | | | | Bond | | | | Result | |
|---|---|---|---|---|---|---|---|---|---|
| Material | Top Roll | Middle Roll | Bottom Roll | Area (%) | Process Setup | T. (° F.) | P. (pli) | Abrasion Resistance | Softness |
| Control 5 | NA | NA | NA | 18 | Single pass | 265 | 600 | 2.5-3.5 | 12-13 |
| Test White 1 | BW | Smooth | Diamond, 19% | 30 | S wrap | 266 | 400-629 | 0.4-0.5 | 30-35 |
| Test DG | BW | Smooth | Diamond, 19% | 30 | S wrap | 266 | 400-629 | 0.2-0.4 | 33-46 |
| Test White 2 | BW | Smooth | Diamond, 19% | 30 | 3 stack with idlers | 266 | 400-629 | 0.5-1.5 | 17-18 |
| Test White 3 | BW | Smooth | NA | 30 | Double Pass | 266 | 75 | 0.5-2.0 | 12-15 |
| Test LG | BW | Smooth | NA | 30 | Double Pass | 266 | 400-629 | 0.4-0.5 | 13-16 |
| Test White 3 | Square | Smooth | NA | 33 | Double Pass | 266 | 343 | 0.5 | 57.3 |
| Test White 4 | Square | Smooth | NA | 13 | Double Pass | 257 | 514 | 1.8 | 23.6 |
| Test White 5 | Square | Smooth | NA | 27 | Double Pass | 257 | 343 | 0.4 | 33.7 |

It can be concluded that the basket-weave pattern at 30% bond area contributed to the improvement in the abrasion resistance significantly for processes of a double pass and a 3 stacks with idlers without compromising softness at the calender speed of 656 ft/min. Softness deteriorated in case of an s wrap whereas it was maintained in case of both a double pass and a double pass of 3 stacks with idlers. Square patterns of similar bond area (about 30%) with negligible transition area showed good abrasion resistance but with softness deteriorated. Square pattern with smaller bond area (13%) showed not only less improvement in abrasion resistance but also deteriorated softness. Strip tensile property was reserved after double pass of calendering with LG.

As hypothesized earlier, the existence of discernible transition area, as evidenced in FIG. 3, in the thus produced basket-weave pattern is responsible for improving the abrasion resistance and the softness at the same time. In contrast, the lack of discernible transition area in the cross-hatch pattern, as shown in FIG. 4, is responsible for its failure to improve softness while improving abrasion resistance.

The nonwoven sheets/webs with the advantageous patterns can of course be further processed or improved. For example, a laminate can be generated by laminating the nonwoven sheets bearing the patterns with a film. The nonwoven sheets/webs or the laminates can be stretched to generate perforations as desired for certain applications such as those described in U.S. Pat. No. 5,964,742.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

We claim:

1. A method of manufacturing a pattern bonded nonwoven fabric comprising the steps of:

spinning and stretching thermoplastic fibers in a spunbonded process, laying the spunbonded thermoplastic fibers down to form a web, bonding the web by hot-roll calendering, through air bonding, cold-roll calendering or by passing the web through a saturated-steam chamber at elevated pressure, and embossing the web by passing the web between a flat roll and an embossed roll having protrusions, a first one of said protrusions comprising a first flat protruded portion having a length between 1.4 and 2.1 mm and a first convex side surface having a radius of 1.8 mm, and a second one of said protrusions adjacent to the first one of said protrusions comprising a second flat protruded portion having a length between 0.8 and 1.1 mm and a second convex side surface having a radius of 0.5 mm to create a basket-weave bond pattern in the web having bonded regions comprising fibers in a fully bonded state and non-bonded regions comprising fibers in a fully non-bonded state connected by transition regions of partially bonded fibers, the transition regions surrounding each of the bonded regions and having bonding that changes gradually from the fully bonded state to the fully non-bonded state, the convex side surface forming the transition regions, the bonded regions having an area comprising about 10% to 45% of the area of the web, the transition regions having an area of at least 100% of the area of the bonded regions.

2. A method according to claim 1, wherein the web is bonded prior to passing the web between the embossed roll and the flat roll.

3. A method according to claim 1, wherein the web is bonded during the step of passing the web between the embossed roll and the flat roll.

4. A method according to claim 2, wherein the web is thermally bonded on a calender roll having an oval pattern and the web is embossed by passing the web through the embossed roll and the flat roll at temperatures between 239° F. to 266° F., speeds between 10 ft/min and 20 ft/min, and nip pressure of 75 pli to 1500 pli.

5. A method according to claim 4, wherein the oval pattern comprises 18% of the area of the web.

6. A method according to claim 4, wherein the web comprises polyethylene/polyethylene terephthalate (PE/PET) bicomponent fibers in a ratio of 40 PE/60 Pet.

7. A method according to claim 1, wherein the web is bonded through pressure bonding with cold calender rolls at room temperature and the web is embossed by passing the web through the embossed roll and the flat roll at temperatures between 239° F. to 266° F., speeds between 10 ft/min and 20 ft/min, and nip pressure of 75 pli to 1500 pli.

8. A method according to claim 1, wherein the area of the bonded regions comprises between about 15% and 40% of the area of the web.

9. A method according to claim 1, further comprising bonding the web to a film by thermal, mechanical or adhesive means to form a laminate.

10. A method according to claim 1, wherein the spunbonded thermoplastic fibers have an average diameter of between 5 and 60 microns.

11. A method according to claim 1, wherein the spunbonded thermoplastic fibers have an average diameter of between 10 and 20 microns.

* * * * *